US007299878B2

(12) United States Patent
Steele

(10) Patent No.: US 7,299,878 B2
(45) Date of Patent: Nov. 27, 2007

(54) HIGH PRESSURE MULTIPLE BRANCH WELLBORE JUNCTION

(75) Inventor: David J. Steele, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 428 days.

(21) Appl. No.: 10/669,759

(22) Filed: Sep. 24, 2003

(65) Prior Publication Data

US 2005/0061511 A1 Mar. 24, 2005

(51) Int. Cl.
*E21B 43/14* (2006.01)
*E21B 7/06* (2006.01)

(52) U.S. Cl. ..... 166/313; 166/50; 166/117.6; 166/242.3

(58) Field of Classification Search ..... 166/50, 166/117.6, 313, 242.3, 242.1; 175/61; 137/561 A; 138/100–102

See application file for complete search history.

(56) References Cited

U.S. PATENT DOCUMENTS

| | | | | |
|---|---|---|---|---|
| 1,900,163 | A | 3/1933 | Dana et al. | |
| 2,492,079 | A | 12/1949 | Wiley | |
| 3,330,349 | A | 7/1967 | Owsley et al. | |
| 4,068,729 | A | 1/1978 | Peevey | |
| 4,099,783 | A | 7/1978 | Verty et al. | |
| 4,222,611 | A | 9/1980 | Larson et al. | |
| 4,249,777 | A | 2/1981 | Morrell et al. | |
| 4,396,075 | A | 8/1983 | Wood et al. | |
| 4,396,230 | A | 8/1983 | Wood et al. | |
| 4,415,205 | A | 11/1983 | Rehm et al. | |
| 4,444,276 | A | 4/1984 | Peterson, Jr. | |
| 4,573,541 | A | 3/1986 | Josse et al. | |
| 4,852,666 | A | 8/1989 | Brunet et al. | |
| 5,012,877 | A | 5/1991 | Winters et al. | |
| 5,052,482 | A | 10/1991 | Gondouin | |
| 5,085,275 | A | 2/1992 | Gondouin | |
| 5,318,122 | A | 6/1994 | Murray et al. | |
| 5,560,435 | A | 10/1996 | Sharp | |
| 5,680,901 | A * | 10/1997 | Gardes | 166/313 |
| 5,941,308 | A * | 8/1999 | Malone et al. | 166/313 |
| 6,056,059 | A * | 5/2000 | Ohmer | 166/313 |
| 6,266,465 | B1 * | 7/2001 | Hickey | 385/45 |
| 6,390,198 | B2 | 5/2002 | Brooks et al. | |
| 6,431,283 | B1 | 8/2002 | Dale | |
| 2004/0159429 | A1 * | 8/2004 | Brockman | 166/250.08 |

OTHER PUBLICATIONS

Maurer Engineering, "Evaluation of Branch and Horizontal Boreholes for In Situ Leach Mining," dated Jul. 1980.
TAML, "TAML Classification System," dated 2003.
Baker Hughes, "Downhold Splitter System," undated.
Baker Hughes, "Downhole Splitter System," dated Nov. 21, 2002.

(Continued)

*Primary Examiner*—Kenneth Thompson
(74) *Attorney, Agent, or Firm*—Marlin R. Smith

(57) ABSTRACT

A high pressure multiple branch wellbore junction. A wellbore junction system includes a wellbore junction with at least three bores extending therethrough. Exits of the three bores are axially spaced apart. At least two deflectors are formed on the wellbore junction. The deflectors are axially spaced apart, and each of the deflectors is aligned with a respective lateral exit of the bores.

43 Claims, 5 Drawing Sheets

OTHER PUBLICATIONS

SPE 69712, "Use of a Fullbore-Access Level 3 Multilateral Junction in the Orinoco Heavy Oil Belt, Venezuela," dated 2001.

Cementing Solutions, Inc., "JIP Studies Cement Integrity," dated Feb. 2002.

Schlumberger, "Rapid Tie Back Quad System," dated Mar. 2002.

Sperry-Sun, "ITBS Isolated Tie-Back System," dated 2000.

Sperry-Sun Pace-6 Pressure-Actuated Casing Exit System, dated 2000.

Sperry-Sun, "Vector Block," dated 2000.

Sperry-Sun, "Multilateral Products, Services, and Solutions," Cover, Copyright Notice and pp. 32 & 33, dated 2000.

* cited by examiner

HIGH PRESSURE MULTIPLE BRANCH WELLBORE JUNCTION

BACKGROUND

The present invention relates generally to equipment utilized and operations performed in conjunction with a subterranean well and, in an embodiment described herein, more particularly provides a high pressure multiple branch wellbore junction.

In the multilateral well completion art it is known to position a wellbore junction at an existing or future wellbore intersection. However, past wellbore junctions have not been constructed to adequately withstand relatively high differential pressures (such as 6,000 psi) at the wellbore intersection. Furthermore, these wellbore junctions have not been provided with pressure ratings equivalent to, or at least 50% of, that of a casing string to which the wellbore junctions are connected.

Therefore, it may be seen that there exists a need in the art for an improved high pressure multiple branch wellbore junction. It is accordingly among the many objects of the invention to provide improved wellbore junctions, wellbore junction systems, and methods of forming a wellbore junction system.

SUMMARY

In carrying out the principles of the present invention, in accordance with an embodiment thereof, a wellbore junction is provided which has a higher pressure rating than current wellbore junctions, while also providing for at least three exits having larger internal dimensions than current wellbore junctions, thereby utilizing the available main wellbore to a greater degree than the current wellbore junctions.

In one aspect of the invention, a wellbore junction system is provided which includes a wellbore junction having three bores extending longitudinally through a single portion of the wellbore junction. A casing string is connected to the wellbore junction. The wellbore junction has a pressure rating of at least 50% of a pressure rating of the casing string.

In another aspect of the invention, a wellbore junction is provided which includes at least three portions: a first portion including a tubular string connection, and at least three bores at opposite ends thereof; a second portion having two of the bores extending therethrough, and a lateral exit of another of the bores; and a third portion having a bore extending therethrough, and a lateral exit of a bore.

In yet another aspect of the invention, a method of forming a wellbore junction system is provided. The method includes the steps of: installing a wellbore junction in a well, the wellbore junction having a tubular string connection, and three bores formed in the wellbore junction; inserting one at a time each of three tubular strings into a respective one of the three bores; and mechanically sealing each of the three tubular strings to the respective one of the three bores.

In a further aspect of the invention, a method of forming a wellbore junction system is provided which includes the steps of: installing two wellbore junctions in a well, each wellbore junction having at least three bores formed therein; and providing communication between one bore of one wellbore junction and a fourth bore of the other wellbore junction.

In a still further aspect of the invention, a method of forming a wellbore junction system includes the steps of: providing two wellbore junctions, each wellbore junction having at least three bores formed therein, and one wellbore junction being smaller in size than the other wellbore junction; and installing the wellbore junctions in a well, the one wellbore junction being positioned in a wellbore portion having a greater inner diameter than another wellbore portion in which the other wellbore junction is positioned.

In another aspect of the invention, a method of forming a wellbore junction system includes the steps of: installing a wellbore junction, the wellbore junction having three bores formed therein; extending each of three tubular strings into a respective one of three wellbores; and sealingly connecting each of the three tubular strings with a respective one of the three bores.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
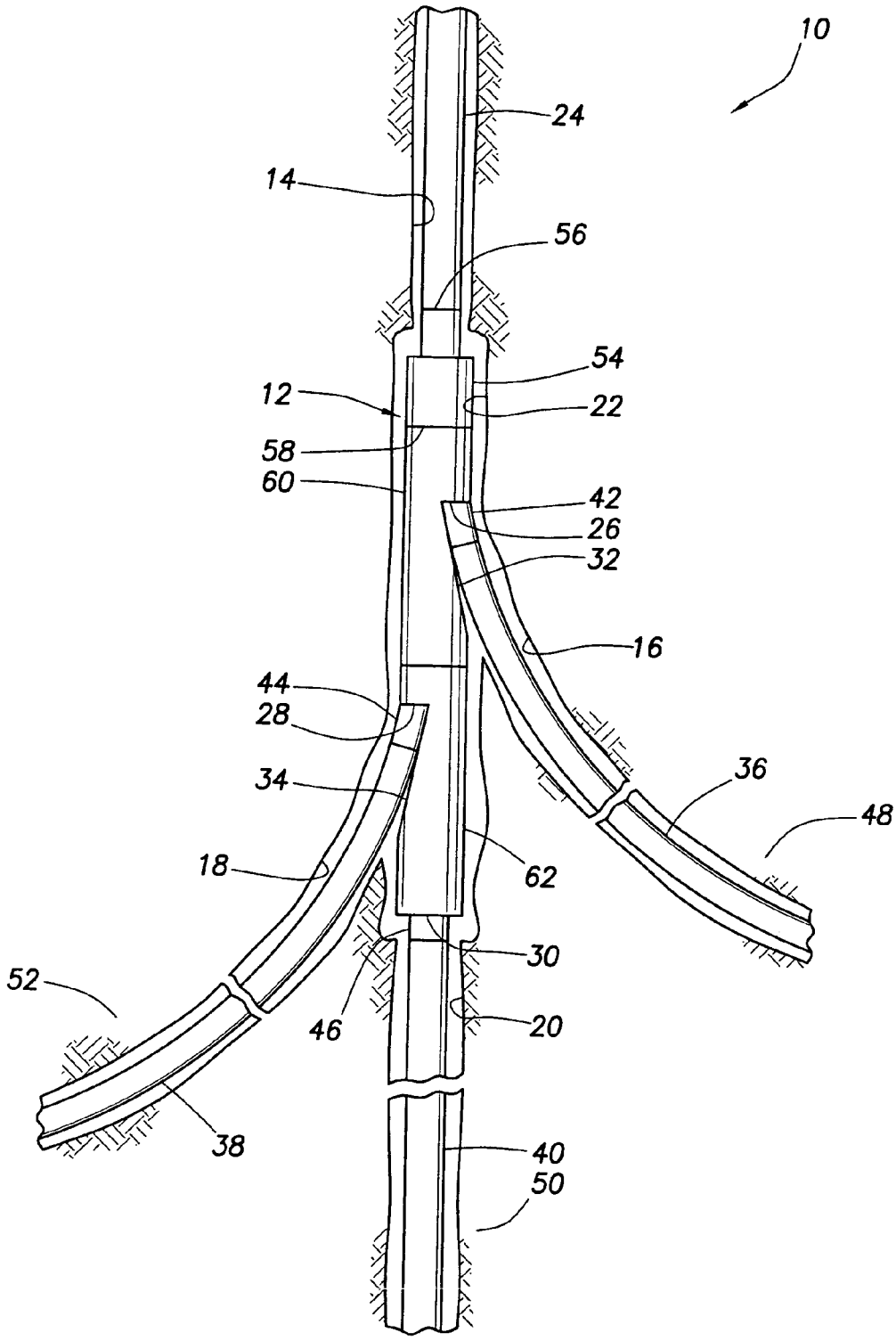
FIG. 1 is a partially cross-sectional view of a wellbore junction system embodying principles of the present invention.

Representatively illustrated in FIG. 1 is a wellbore junction system 10 which embodies principles of the present invention. In the following description of the system 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, the wellbore junction system 10 includes a wellbore junction 12 positioned in a main or parent wellbore 14 at an intersection between the main wellbore and each of an upper lateral or branch wellbore 16, a middle lateral or branch wellbore 18 and a lower lateral or branch wellbore 20. The intersections between these wellbores 14, 16, 18, 20 may be formed prior to installing the wellbore junction 12, or the wellbore junction may be positioned in the main wellbore 14 prior to drilling any or all of the other wellbores 16, 18, 20. That is, the intersection may be formed before or after the junction is positioned at the intersection.

In one method, the main wellbore 14 is drilled, and a radially enlarged cavity 22 is then formed in the main wellbore, for example, by underreaming. The wellbore junction 12 is then installed in the cavity 22, conveyed on a tubular string 24, such as a casing string. The wellbore junction 12 may be rotationally (azimuthally) oriented relative to the wellbore 14 (for example, to orient the wellbore junction so that the wellbores 16, 18 will extend in desired directions), by using a gyroscope or other orientation indicating device engaged with the wellbore junction, and rotating the casing string 24 at the surface to achieve the desired orientation of the wellbore junction.

At this point, the wellbore junction 12 and casing string 24 may be cemented in the main wellbore 14, although this is not necessary in keeping with the principles of the invention. Note that it is also not necessary for the wellbore junction 12 to be installed in the enlarged cavity 22.

If the wellbore junction 12 is cemented in the wellbore 14, then preferably upper, middle and lower exits 26, 28, 30 on the wellbore junction 12 are provided with means to prevent cement flowing into the wellbore junction through the exits. For example, the upper and middle exits 26, 28 may be provided with temporary sealing devices, such as a bridge plug, a plug made of cement (similar to a cement float shoe), or a composite or relatively soft (millable or drillable) material (similar to a drillable bridge plug). The lower exit 30 may be provided with a cementing float shoe. Thus, cement is pumped down the casing string 24, into the wellbore junction 12, outward through the lower exit 30, and into the annulus between the wellbore 14 and the wellbore junction/casing string.

The other wellbores 16, 18, 20 are then drilled by passing cutting tools, such as drill bits, reamers, mills, etc., through the respective upper, middle and lower exits 26, 28, 30 on the wellbore junction 12. This operation may include removing the plugs from the exits 26, 28. Note that the exits 26, 28, 30 are axially spaced apart on the wellbore junction 12 and along a longitudinal axis of the main wellbore 14. In addition, although not apparent from the illustration in FIG. 1, the exits 26, 28, 30 are also radially spaced apart in the wellbore junction 12.

A cutting tool passing outward through the upper exit 26 will be laterally deflected by an upper whipstock or deflector 32 formed on the wellbore junction 12 to form the upper branch wellbore 16. A cutting tool passing outward through the middle exit 28 will be laterally deflected by a lower whipstock or deflector 34 formed on the wellbore junction 12 to form the middle branch wellbore 18.

A cutting tool passing outward through the lower exit 30 will form the lower branch wellbore 20. Note that the lower branch wellbore 20 may be considered a lower portion of the main wellbore 14, in which case it may be formed when the main wellbore is drilled, and thus there may be no need to drill the lower branch wellbore 20 after installing the wellbore junction 12. Furthermore, the lower branch wellbore 20 could extend laterally relative to the main wellbore 14 (as depicted for the upper and middle branch wellbores 16, 18), if desired.

As mentioned above, the branch wellbores 16, 18, 20, or any of them, may be drilled prior to installing the wellbore junction 12 in the main wellbore 14. Indeed, the principles of the invention are not limited to any particular steps or order of steps described herein.

Note that the exits 26, 28, 30 are radially aligned with the respective branch wellbores 16, 18, 20, and the deflectors 32, 34 are radially aligned with the respective branch wellbores 16, 18. Each of the deflectors 32, 34 is also positioned between two of the exits 26, 28, 30, that is, the deflectors and exits alternate along the longitudinal axis of the wellbore junction 12. The inventor has found that this construction of the wellbore junction 12 contributes to its ability to withstand greater differential pressures than has been achieved in the past.

For example, the wellbore junction 12 is capable of withstanding at least 6,000 psi between its interior and exterior. Furthermore, the wellbore junction 12 is capable of withstanding at least 6,000 psi differential between any two of its bores 64, 66, 68 (not visible in FIG. 1, see FIG. 2), and between any of the wellbores 14, 16, 18, 20 and any of the bores, without bursting or collapsing.

A tubular string 36, such as a casing, liner or tubing string, is lowered through the wellbore junction 12, outward through the upper exit 26, deflected laterally off of the upper deflector 32, and into the upper branch wellbore 16. In a similar manner, another tubular string 38 is lowered through the wellbore junction 12, outward through the middle exit 28, deflected laterally off of the lower deflector 34, and into the middle branch wellbore 18. Another tubular string 40 is lowered through the wellbore junction 12, outward through the lower exit 30, and into the lower branch wellbore 20. Preferably, the tubular strings 36, 38, 40 are installed one at a time through the wellbore junction 12, rather than simultaneously.

The tubular strings 36, 38, 40 are secured and sealed to the wellbore junction 12 using, for example, respective liner hangers 42, 44, 46 engaged with seal bores (not visible in FIG. 1) at the respective exits 26, 28, 30. Preferably, the liner hangers 42, 44, 46 are of the type known to those skilled in the art as liner hanger packers which both mechanically seal the tubular strings 36, 38, 40 to the respective bores 64, 66, 68 and secure/anchor the liner strings to the bores. The bores 64, 66, 68 could be provided with other types of sealing and/or securing means if desired. For example, a latch profile may be formed in each of the bores 64, 66, 68, and each of the tubular strings 36, 38, 40 could have a latch, instead of a liner hanger, to secure the tubular string to the profile.

As used herein, the terms "mechanical seal" or "mechanically sealing" indicate a seal or process of sealing which energizes the seal against a surface, such as by compressing an elastomeric or nonelastomeric seal against a surface, or by compressing metal surfaces against each other to form a metal-to-metal seal, etc. The terms "mechanical seal" or "mechanically sealing" do not indicate a seal formed by flowing a material, such as cement, between surfaces to be sealed to each other.

The tubular strings 36, 38, 40 may communicate with respective zones or formations 48, 50, 52 intersected by the respective branch wellbores 16, 18, 20, or multiple ones of the tubular strings may communicate with the same zone or formation, such as in an injection/production well.

Note that use of all or any of the tubular strings 36, 38, 40 is not necessary. If the tubular strings 36, 38, 40, or any of them, are used, they may be cemented in the branch wellbores 16, 18, 20 along the entire respective branch wellbores, or any portions thereof, or not cemented at all.

The casing string 24 is depicted in FIG. 1 connected to an upper connection 56 of the wellbore junction 12. Although not visible in FIG. 1, one or more tubular strings, such as production tubing strings, may be installed in the casing string 24 and placed in fluid communication with one or more of the bores in the wellbore junction. For example, each one of multiple production tubing strings may be placed in fluid communication with a respective one of the bores in the wellbore junction 12, so that fluid from the respective zones 48, 50, 52 remains segregated in the casing string 24. Alternatively, the fluid from the zones 48, 50, 52 could be commingled in the casing string 24, if desired.

From the above description, it will be appreciated that the wellbore junction 12 includes an upper portion 54 having the connection 56 (which may be a threaded bore) to the casing string 24 at one end, and three bores (not visible in FIG. 1) extending through an opposite end 58. A middle portion 60 has the three bores extending therethrough, the upper exit 26, and the upper deflector 32 formed thereon. A lower portion 62 of the wellbore junction 12 has two of the bores extending therethrough, the middle and lower exits 28, 30, and the lower deflector 34 formed thereon.

Note that the casing string 24, the wellbore junction 12 and the tubular string 40 can have the same outer diameter, instead of the different diameters depicted in FIG. 1.

Figure 8:
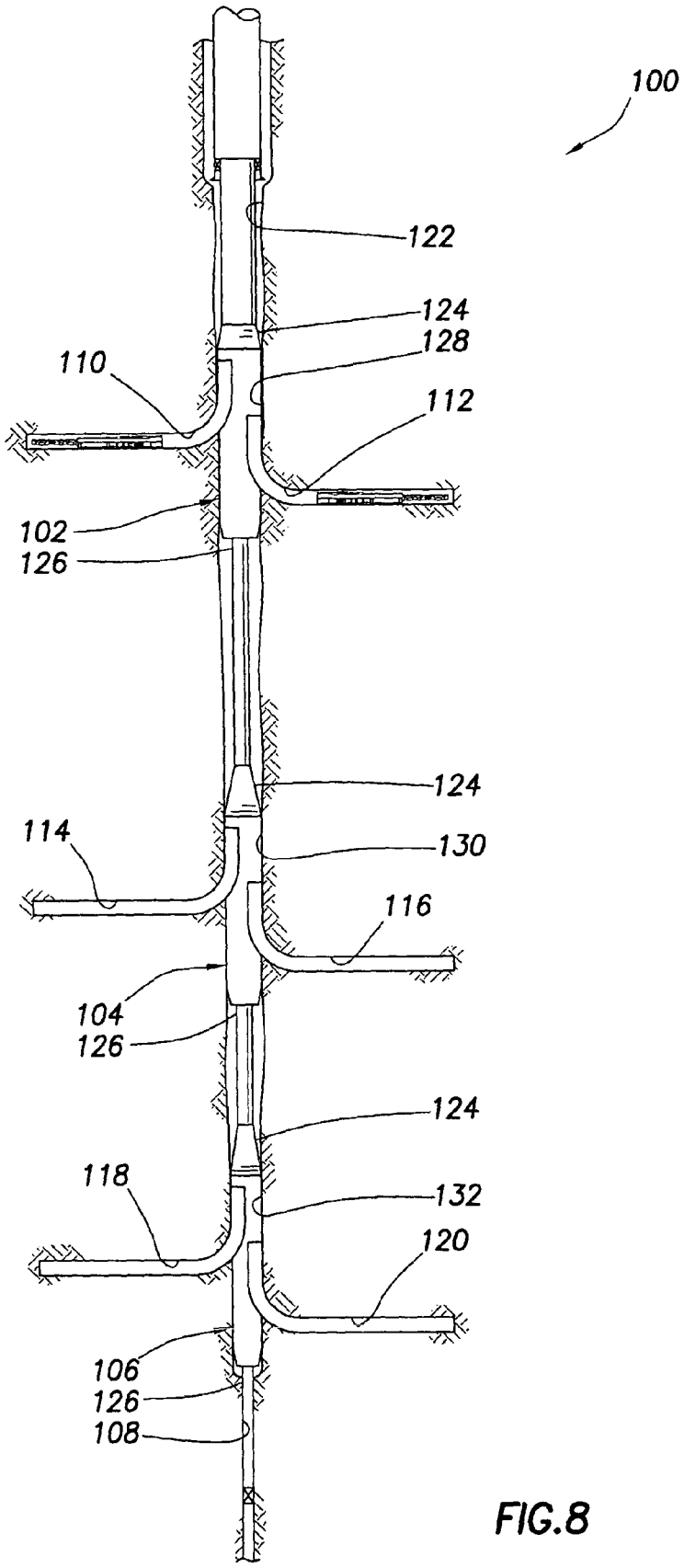
FIG. 8 is a partially cross-sectional view of another wellbore junction system embodying principles of the present invention.

In yet another unique feature of the invention, the wellbore junction 12 is modular, in that multiple ones of the wellbore junction may be used in a single main wellbore, or a wellbore junction in one wellbore may be connected to a wellbore junction in another wellbore. For example, another wellbore junction 12 in the lower branch wellbore 20 may be connected below the wellbore junction depicted in FIG. 1 by, for example, connecting the tubular string 40 to the upper portion 54 of the wellbore junction in the lower branch wellbore. In this manner, the wellbore junctions 12 may be connected together and distributed axially along the main wellbore 14. An example of such a wellbore junction system is depicted in FIG. 8, and is described below.

As another example, another wellbore junction 12 installed in one of the branch wellbores 16, 18 may be connected to the wellbore junction depicted in FIG. 1 by connecting the corresponding tubular string 36 or 38 to the upper portion 54 of the wellbore junction in the branch wellbore. Thus, the principles of the invention are not limited to the method depicted in FIG. 1.

Figure 2:
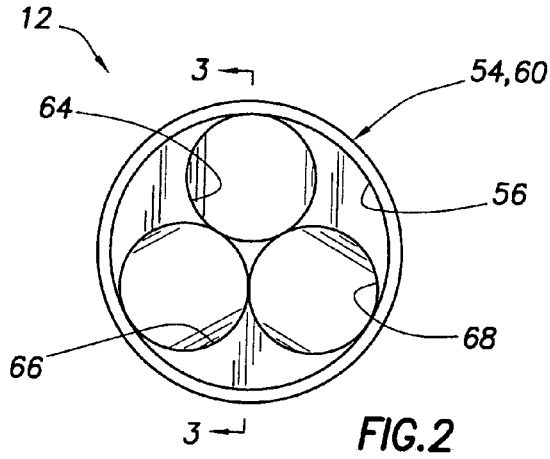
FIG. 2 is cross-sectional view of upper and middle portions of the wellbore junction system.

Referring additionally now to FIG. 2, a top view is representatively illustrated of one embodiment of the upper and middle portions 54, 60 of the wellbore junction 12. In this view the upper connection 56 to the casing string 24 may be seen, as well as the three radially spaced apart bores 64, 66, 68.

Each of the bores 64, 66, 68 may be in communication with the interior of the casing string 24 via the tubular upper end 56. Alternatively, as described above, one or more tubular strings in the casing string 24 may be placed in fluid communication with respective one or more of the bores 64, 66, 68. Also, one or more tubular strings may extend from within the casing string 24, through respective one or more of the bores 64, 66, 68 and into respective one or more of the wellbores 16, 18, 20.

Preferably, the bores 64, 66, 68 are radially spaced apart by approximately 120 degrees about a longitudinal axis 70 of the wellbore junction 12. When positioned in the wellbore 14, the longitudinal axis 70 of the wellbore junction 12 corresponds to the longitudinal axis of the wellbore. Thus, the bores 64, 66, 68 are also radially spaced apart relative to the wellbore 14.

The inventor has found that the positioning and quantity of the bores 64, 66, 68 in this configuration best utilizes the available cross-sectional area of the wellbore 14, while achieving a pressure rating for the wellbore junction 12 which is at least 50% that of the casing string 24, and preferably at least as great as the pressure rating of the casing string. The pressure rating of the wellbore junction 12 is for differential pressure applied between the exterior of the wellbore junction and any of the bores 64, 66, 68. The pressure rating of the casing string 24 is for differential pressure applied between the interior and exterior of the casing string. That is, the burst and collapse pressure ratings of the wellbore junction 12 are at least 50% of the burst and collapse pressure ratings of the casing string 24, and preferably the burst and collapse pressure ratings of the wellbore junction are at least as great as the burst and collapse pressure ratings of the casing string.

A conventional orienting latch profile (not shown) may be included in the upper portion 54, or in the casing string 24 above the upper portion 54, in order to direct cutting tools, tubular strings, etc. into selected ones of the bores 64, 66, 68. A deflector (not shown) engaged with the profile would deflect the cutting tools, tubular strings, etc. into the selected one of the bores 64, 66, 68.

Figure 3:
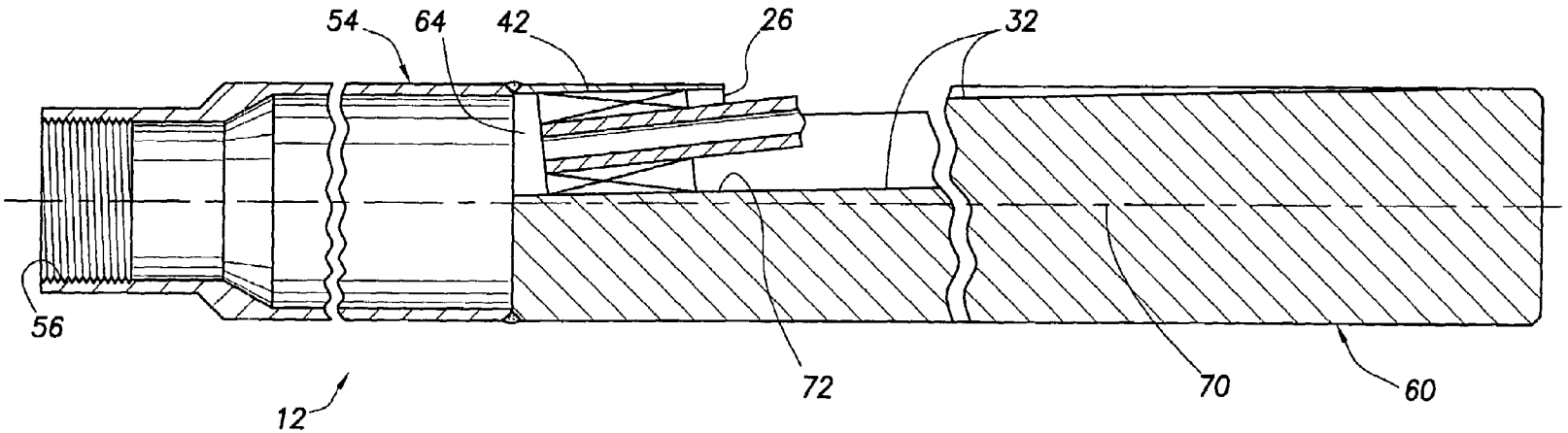
FIG. 3 is cross-sectional view of the wellbore junction system, taken along line 3-3 of FIG. 2.

Referring additionally to FIG. 3, a cross-sectional view of the upper and middle portions 54, 60 is illustrated. In the illustrated embodiment, the upper and middle portions 54, 60 are provided as a single structure made up of welded together components, but it will be readily appreciated that they could be integrally formed as a single piece or separately provided in keeping with the principles of the invention.

In this view, the manner in which the upper exit 26 and upper deflector 32 are formed may be appreciated. The upper exit 26 has a seal bore 72 in which the liner hanger 42 is set to sealingly secure the liner string 36. Alternatively, or in addition, a conventional latch profile may be formed in the bore 64 to secure the liner string 36.

Figure 4:
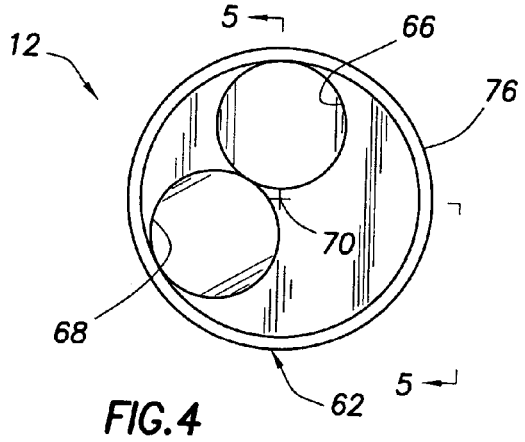
FIG. 4 is a top view of an upper connector of a lower portion of the wellbore junction system.

Referring additionally now to FIG. 4, a top view of an upper connector 76 of one embodiment of the lower portion 62 of the wellbore junction 12 is representatively illustrated. The upper connector 76 may be sealingly secured to the middle portion 60 by, for example, threading or welding.

Figure 5:
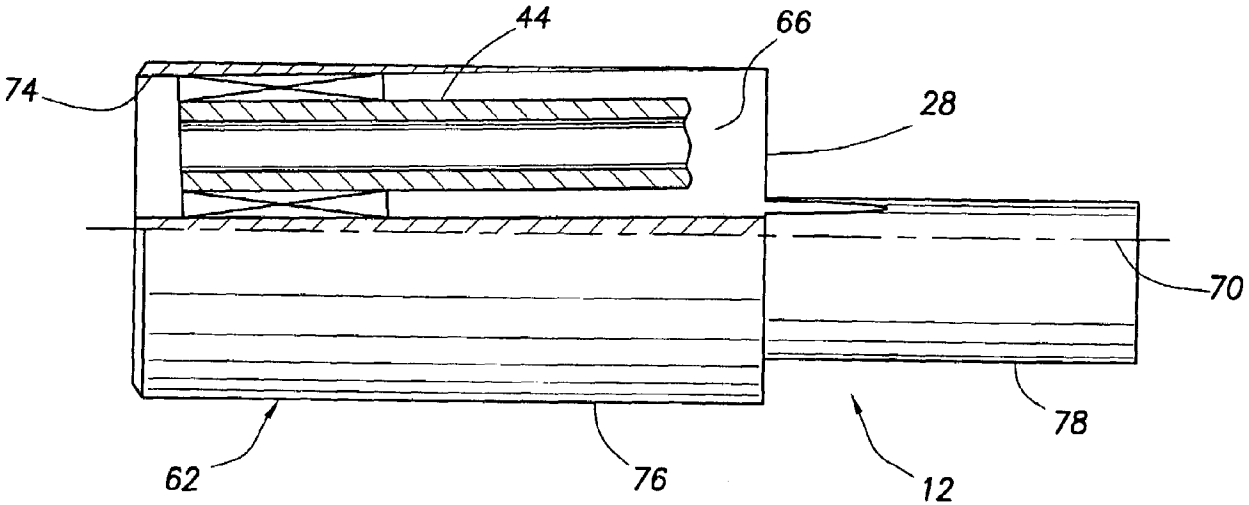
FIG. 5 is a cross-sectional view of the wellbore junction system, taken along line 5-5 of FIG. 4.

In FIG. 5 is depicted a cross-sectional view of the upper connector 76. For clarity of illustration, the connector 76 is illustrated in FIGS. 4 & 5 rotated 120 degrees about the axis 70, but in actual practice the bores 66, 68 are aligned with the same bores in the middle portion 60, as depicted in FIG. 2.

The liner hanger 44 is sealingly secured in a seal bore 74 at the middle exit 28. Note that the bore 66 is somewhat inclined laterally in the connector 76. Alternatively, or in addition, a conventional latch profile may be formed in the bore 66 to secure the liner string 38.

The bore 68 extends through a tubular extension 78 of the upper connector 76. The tubular extension 78 is used to attach the upper connector 76 to a tubular extension 80 at an upper end of a lower connector 82 of the lower portion 62 of the wellbore junction 12 representatively illustrated in FIG. 6. A cross-sectional view of the connector 82 is depicted in FIG. 7.

Figure 6:
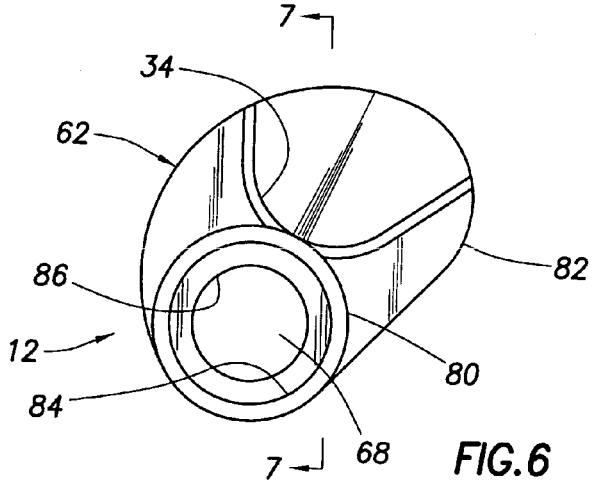
FIG. 6 is a top view of a lower connector of the lower portion of the wellbore junction system.
Figure 7:
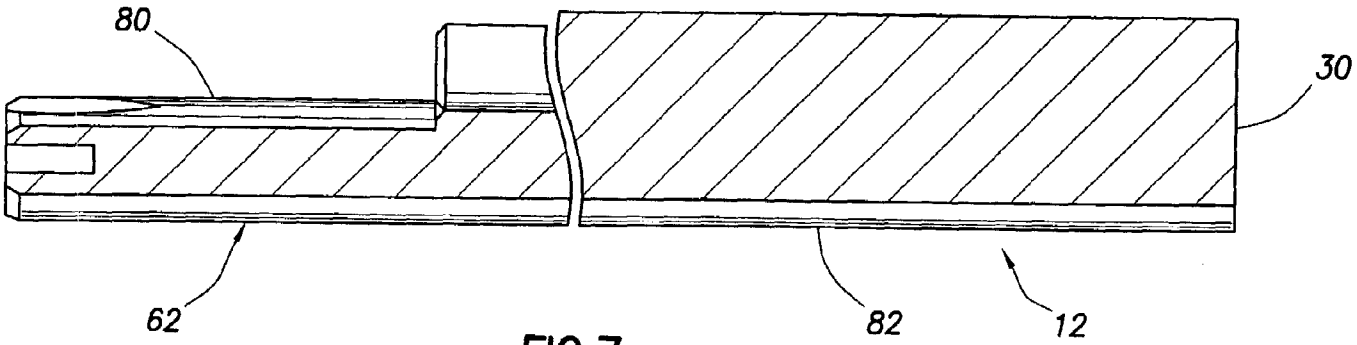
FIG. 7 is a cross-sectional view of the wellbore junction system, taken along line 7-7 of FIG. 6.

In FIGS. 6 & 7 it may be seen that the bore 68 extends through the lower connector 82. The liner string 40 is sealingly secured in a seal bore 84 of the lower exit 30 using a liner hanger 86. The bore 68 extends through the lower exit 30. Alternatively, or in addition, a conventional latch profile may be formed in the bore 68 to secure the liner string 40.

The deflector 34 is radially aligned with the bore 66 in the upper connector 76. The upper and lower connectors 76, 82 may be sealingly secured to each other, for example, by threading or welding the tubular extensions 78, 80 to each other, with the middle exit 28 radially aligned with the deflector 34.

Note that the bore 68 does not extend laterally, but is instead parallel to the axis 70 and, thus, parallel to the connection 56. This configuration enables convenient interconnection of the lower exit 30 of one wellbore junction 12 to the upper connection 56 of another wellbore junction, so that the wellbore junctions may be distributed axially along the wellbore 14. However, the bore 68 could extend laterally relative to the axis 70, it desired.

The wellbore junction 12 and/or the tubular strings 36, 38, 40 may be equipped with flow control devices (such as chokes, valves, etc.), sensors (such as pressure, temperature, flow rate, fluid identification, etc., sensors) and communication devices (such as transmitters, receivers, etc.) and other components of an "intelligent" well completion. These devices may communicate with a remote location (such as the earth's surface or another location in the well) using hardwire, acoustic telemetry, electromagnetic telemetry, mud pulse telemetry, or any other form of communication.

Referring additionally now to FIG. 8, a wellbore junction system 100 embodying principles of the invention is representatively and schematically illustrated. The system 100 utilizes three wellbore junctions 102, 104, 106, each of which is similar to the wellbore junction 12 described above. Of course, any number of wellbore junctions may be used in keeping with the principles of the invention.

The wellbore junctions 102, 104, 106 are interconnected to each other in a unique manner which permits convenient and efficient distribution of multiple branch wellbores 108, 110, 112, 114, 116, 118, 120 extending outward from a main wellbore 122. Note that the lowermost branch wellbore 108 may be considered a lower portion of the main wellbore 122.

The wellbore junctions 102, 104, 106 are axially spaced apart, an upper connection 124 of each of the lower wellbore junctions being connected to a lower connection 126 of the respective next higher wellbore junction. One benefit of "stacking" the wellbore junctions 102, 104, 106 in this manner is that each additional wellbore junction provides for at least two additional branch wellbores.

Another benefit is that the wellbore junctions 102, 104, 106 may be sized to fit within corresponding wellbore portions 128, 130, 132. For example, the wellbore portion 128 may have an inner diameter of 21 inches and the wellbore junction 102 may have an outer diameter of 18.2 inches, the wellbore portion 130 may have an inner diameter of 17½ inches and the wellbore junction 104 may have an outer diameter of 15 inches, and the wellbore portion 132 may have an inner diameter of 15 inches and the wellbore junction 106 may have an outer diameter of 14 inches.

Thus, the wellbore portions 128, 130, 132 may step down in diameter as the main wellbore 122 is drilled, and the wellbore junctions 102, 104, 106 may correspondingly step down in size to efficiently utilize the available cross-sectional area of the wellbore.

Of course, a person skilled in the art would, upon a careful consideration of the above description of a representative embodiment of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A wellbore junction system, comprising:

a wellbore junction including at least first, second and third bores extending longitudinally through a single portion of the wellbore junction;

a casing string connected to the wellbore junction; and first, second and third tubular strings, and first, second and third wellbores, and wherein each of the first, second and third tubular strings provides a flowpath between a respective one of the first, second and third bores and a respective one of the first, second and third wellbores, wherein the wellbore junction has a pressure rating of at least 50% of a pressure rating of the casing string.

2. The wellbore junction system according to claim 1, wherein each of the first, second and third tubular strings is sealingly secured to the respective one of the first, second and third bores.

3. The wellbore junction system according to claim 1, further comprising first and second ones of the wellbore junction, the third tubular string providing a flowpath between the third bore of the first wellbore junction and a fourth bore of the second wellbore junction.

4. The wellbore junction system according to claim 1, wherein a fourth tubular string provides a flowpath to a fourth bore of the wellbore junction and is positioned in a fourth wellbore.

5. The wellbore junction system according to claim 1, wherein the fourth bore is in communication with each of the first, second and third bores in the wellbore junction.

6. A wellbore junction system, comprising:

a wellbore junction including at least first, second and third bores extending longitudinally through a single portion of the wellbore junction; and a casing string connected to the wellbore junction, wherein the wellbore junction has a pressure rating of at least 50% of a pressure rating of the casing string, and wherein the first, second and third bores are radially spaced apart in the wellbore junction portion by approximately 120 degrees about a longitudinal axis of the wellbore junction.

7. A wellbore junction system, comprising:

first and second wellbore junctions, each including at least first, second and third bores extending longitudinally through a single portion of the respective wellbore junction, and the third bore of the first wellbore junction being in communication with a fourth bore of the second wellbore junction; and a casing string connected to the wellbore junction, wherein each of the first and second wellbore junctions has a pressure rating of at least 50% of a pressure rating of the casing string.

8. A wellbore junction, comprising:

a first portion including at opposite ends thereof a tubular string connection, and first, second and third bores;

a second portion having the second and third bores extending therethrough, and a lateral exit of the first bore; and a third portion having the third bore extending therethrough, and a lateral exit of the second bore, and wherein the wellbore junction is configured to resist at least 6,000 pounds per square inch differential pressure applied between any two of the tubular string connection and the first, second and third bores.

9. The wellbore junction according to claim 8, wherein the wellbore junction is configured to resist at least 6,000 pounds per square inch differential pressure applied between an exterior of the wellbore junction and any of the tubular string connection and the first, second and third bores.

10. The wellbore junction according to claim 8, wherein the first portion first tubular string connection is in communication with each of the first, second and third bores.

11. The wellbore junction according to claim 8, further comprising a first deflector formed on the second portion, the first deflector being aligned with the lateral exit of the first bore.

12. The wellbore junction according to claim 11, further comprising a second deflector formed on the third portion, the second deflector being aligned with the lateral exit of the second bore.

13. The wellbore junction according to claim 12 wherein the first deflector is positioned between the lateral exit of the first bore and the lateral exit of the second bore.

14. The wellbore junction according to claim 13, wherein the second deflector is positioned between the lateral exit of the second bore and an exit of the third bore.

15. The wellbore junction according to claim 14, wherein the third bore exit is substantially parallel to the tubular string connection.

16. A method of forming a wellbore junction system, the method comprising the steps of:

installing a wellbore junction in a well, the wellbore junction having a tubular string connection, and first, second and third bores formed in the wellbore junction;

providing the wellbore junction having a pressure rating of at least 50% of a pressure rating of a casing string connected to the tubular string connection;

inserting one at a time each of first, second and third tubular strings into a respective one of the first, second and third bores; and mechanically sealing each of the first, second and third tubular strings to the respective one of the first, second and third bores.

17. The method according to claim 16, wherein the installing step further comprises positioning the wellbore junction in an underreamed cavity.

18. The method according to claim 17, wherein the installing step further comprises connecting the tubular string connection to a fourth tubular string.

19. The method according to claim 18, wherein the connecting step further comprises providing communication between the fourth tubular string and each of the first, second and third bores.

20. The method according to claim 17, wherein the installing step further comprises installing first and second ones of the wellbore junction, the third bore of the first wellbore junction being in communication with the tubular string connection of the second wellbore junction.

21. The method according to claim 20, wherein in the installing step, the second wellbore junction is smaller in size than the first wellbore junction, and wherein the first wellbore junction is positioned in a first wellbore portion having a greater inner diameter than a second wellbore portion in which the second wellbore junction is positioned.

22. The method according to claim 16, further comprising the step of configuring the wellbore junction to resist at least 6,000 pounds per square inch differential pressure applied between any two of the first, second and third bores.

23. The method according to claim 16, further comprising the step of radially spacing apart by approximately 120 degrees the first, second and third bores in a single portion of the wellbore junction.

24. The method according to claim 16, wherein the installing step further comprises:

plugging at least two of the first, second and third bores; and then flowing cement about the wellbore junction in the well.

25. The method according to claim 16, further comprising the step of securing each of the first, second and third tubular strings to the respective one of the first, second and third bores.

26. A method of forming a wellbore junction system, the method comprising the steps of:

installing at least first and second wellbore junctions in a well, each wellbore junction having at least first, second and third bores formed therein, and positioning the first wellbore junction in an underreamed cavity; and providing communication between the third bore of the first wellbore junction and a fourth bore of the second wellbore junction.

27. A method of forming a wellbore junction system, the method comprising the steps of:

installing at least first and second wellbore junctions in a well, each wellbore junction having at least first, second and third bores formed therein;

providing communication between the third bore of the first wellbore junction and a fourth bore of the second wellbore junction;

extending each of first, second and third tubular strings into respective first, second and third wellbores; and sealingly connecting each of the first, second and third tubular strings with the respective first, second and third bores of the first wellbore junction.

28. A method of forming a wellbore junction system, the method comprising the steps of:

providing at least first and second wellbore junctions, each wellbore junction having at least first, second and third bores formed therein, and the second wellbore junction being smaller in size than the first wellbore junction; and installing the first and second wellbore junctions in a well, the first wellbore junction being positioned in a first wellbore portion having a greater inner diameter than a second wellbore portion in which the second wellbore junction is positioned.

29. The method according to claim 28, further comprising the step of providing communication between the third bore of the first wellbore junction and a fourth bore of the second wellbore junction.

30. The method according to claim 28, wherein the installing step further comprises positioning the first wellbore junction in an underreamed cavity.

31. The method according to claim 28, further comprising the steps of:

extending each of first, second and third tubular strings into respective first, second and third wellbores; and sealingly connecting each of the first, second and third tubular strings with the respective first, second and third bores of the first wellbore junction.

32. A method of forming a wellbore junction system, the method comprising the steps of:

installing first and second wellbore junctions, each wellbore junction having first, second and third bores formed therein, and the installing step further comprising positioning the wellbore junctions in an underreamed cavity formed in a fourth wellbore, the third bore of the first wellbore junction being in communication with a fourth bore of the second wellbore junction;

extending each of first, second and third tubular strings into a respective one of first, second and third wellbores; and sealingly connecting each of the first, second and third tubular strings with a respective one of the first, second and third bores.

33. The method according to claim 32, wherein the installing step further comprises connecting each of the wellbore junctions to a fourth tubular string.

34. The method according to claim 33, wherein the connecting step further comprises providing communication between the fourth tubular string and each of the first, second and third bores.

35. The method according to claim 32, wherein in the installing step, the second wellbore junction is smaller in size than the first wellbore junction, and wherein the first wellbore junction is positioned in a first wellbore portion having a greater inner diameter than a second wellbore portion in which the second wellbore junction is positioned.

36. A wellbore junction, comprising:

a first portion including at opposite ends thereof a tubular string connection, and first, second and third bores;

a second portion having the second and third bores extending therethrough, and a lateral exit of the first bore; and a third portion having the third bore extending therethrough, and a lateral exit of the second bore, and wherein the wellbore junction is configured to resist at least 6,000 pounds per square inch differential pressure applied between an exterior of the wellbore junction and any of the tubular string connection and the first, second and third bores.

37. The wellbore junction according to claim 36, wherein the wellbore junction is configured to resist at least 6,000 pounds per square inch differential pressure applied between any two of the tubular string connection and the first, second and third bores.

38. The wellbore junction according to claim 36, wherein the first portion first tubular string connection is in communication with each of the first, second and third bores.

39. The wellbore junction according to claim 36, further comprising a first deflector formed on the second portion, the first deflector being aligned with the lateral exit of the first bore.

40. The wellbore junction according to claim 39, further comprising a second deflector formed on the third portion, the second deflector being aligned with the lateral exit of the second bore.

41. The wellbore junction according to claim 40 wherein the first deflector is positioned between the lateral exit of the first bore and the lateral exit of the second bore.

42. The wellbore junction according to claim 41, wherein the second deflector is positioned between the lateral exit of the second bore and an exit of the third bore.

43. The wellbore junction according to claim 42, wherein the third bore exit is substantially parallel to the tubular string connection.

* * * * *